US006172645B1

(12) United States Patent
Hollander et al.

(10) Patent No.: US 6,172,645 B1
(45) Date of Patent: Jan. 9, 2001

(54) INTEGRATED EXTENDABLE PCMCIA ANTENNA

(75) Inventors: Evan A. Hollander, Buffalo Grove; Scott A. Stratmoen, Arlington Heights, both of IL (US)

(73) Assignee: Northrop Grumman Corporation, Los Angeles, CA (US)

( * ) Notice: Under 35 U.S.C. 154(b), the term of this patent shall be extended for 0 days.

(21) Appl. No.: 09/020,074

(22) Filed: Feb. 6, 1998

(51) Int. Cl.[7] ..... H01Q 1/24
(52) U.S. Cl. ..... 343/702; 343/700 MS
(58) Field of Search ..... 343/702, 700 MS, 343/767, 768; 235/486, 487, 492, 375, 384; 375/222; 455/90

(56) References Cited

U.S. PATENT DOCUMENTS

| | | | |
|---|---|---|---|
| 4,598,295 | 7/1986 | Murphy | 343/702 |
| 4,665,519 | 5/1987 | Kirchner et al. | 370/94 |
| 5,138,328 | 8/1992 | Zibrik et al. | 343/702 |
| 5,218,187 | 6/1993 | Koenck et al. | 235/375 |
| 5,243,355 | 9/1993 | Emmert et al. | 343/702 |
| 5,261,055 | 11/1993 | Moran et al. | 395/275 |
| 5,300,938 | 4/1994 | Maroun et al. | 343/702 |
| 5,302,947 | 4/1994 | Fuller et al. | 340/825.34 |
| 5,321,240 | 6/1994 | Takahira | 235/380 |
| 5,322,991 | 6/1994 | Hanson | 235/472 |
| 5,918,163 * | 6/1999 | Rossi | 455/90 |
| 5,918,189 * | 6/1999 | Kivela | 455/575 |

* cited by examiner

*Primary Examiner*—Hoanganh Le
*Assistant Examiner*—Trinh Vo Dinh
(74) *Attorney, Agent, or Firm*—Terry J. Anderson; Karl J. Hoch, Jr.

(57) ABSTRACT

A PCMCIA modem card which is connectable a host computer and utilizes an integrated, extendable antenna for wireless transmission and reception, is provided with a circuit board. The circuit board is provided with a cavity interior. The cavity extends to a first end of the circuit board. The modem card is further provided with communications circuitry which is formed on the circuit board. The modem card is further provided with an antenna structure which is in electrical communication with the communications circuitry. The antenna structure is translatable from a first position wherein the antenna structure is substantially disposed within the cavity and a second position wherein the antenna structure is extended from the cavity.

47 Claims, 6 Drawing Sheets

INTEGRATED EXTENDABLE PCMCIA ANTENNA

FIELD OF THE INVENTION

The present invention relates generally to antennas and more particularly to an extendable antenna integral to a PCMCIA type modem card.

BACKGROUND OF THE INVENTION

The rapid development of worldwide adoption of PC Card technology has been due in large part to the standards efforts of the Personal Computer Memory Card International Association (PCMCIA). The PC Card standard defines a 68-pin interface between the peripheral cards and the socket into which it is inserted.

The PC Card standard provides physical specification for three types of cards, with additional provisions for extended cards (increased length). All three card types measure the same length and width, 85.6 mm and 54.0 mm respectively. The thicknesses are 3.3, 5.0 and 10.5 millimeters for the Type I, Type II and Type III cards respectively. Smaller cards can fit into larger sockets.

The card types each have features that fit the needs of different applications. Type I PC Cards are typically used for memory devices. Type II PC Cards are typically used for I/O devices such as data/fax modems (including wireless modems), pagers, LANs, and mass storage devices. Type III PC Cards are used for devices which components are thicker, such as rotating mass storage devices. Extended cards, those having longer lengths than that of the standard three types, allow for the addition of components that must remain outside the system for proper operation. A common example of such components is antennas for wireless modem applications.

A PC modem card can provide wireless communication capability to laptop notebook personal computers, hand held computers and any other host computer system having a PCMCIA-compatible interface. In order for a PC modem card to properly operate, the card must be connected to an antenna.

A conventional antenna arrangement utilizes extended cards. Inherently, these cards have longer lengths than the three PCMCIA standard types. For this reason, this arrangement is undesirable because conformity with the three PCMCIA standard types. Furthermore this arrangement is undesirable because such an extended card must extend beyond the housing of the host computer, regardless of whether the antenna is in use.

Another conventional antenna arrangement employs an antenna attached to a printed circuit board of a modem card. The problem with this arrangement, however, is that by attaching the antenna to the card the overall thickness of the card is increased. In the computer age, however, smaller is better, or in this case, thinner is better. Moreover, it is desirable to have an antenna/card design which conforms to the PCMCIA Card dimensional standards. Depending upon the PCMCIA card type, an arrangement with an antenna affixed on top of the circuit board may violate the standards.

In addition, modem cards are typically randomly oriented during use and, thus, suffer from multipath reflections and rotation of polarization. It is therefore desirable for the antenna connected to the modem card to be reorientated to adjust the polarization and to mitigate multipath reflections.

It is therefore evident that there exists a need in the art for a modem card antenna design which conforms to PCMCIA Card standards, does not require the antenna to be exposed from the host computer when not in use, and allows for freedom of antenna orientation to adjust the antenna polarization and to mitigate multipath reflections.

SUMMARY OF THE INVENTION

In accordance with the present invention, a PCMCIA modem card which is connectable a host computer and utilizes an integrated, extendable antenna for wireless transmission and reception, is provided with a circuit board. The circuit board is provided with a cavity interior. The cavity extends to a first end of the circuit board. The modem card is further provided with communications circuitry which is formed on the circuit board. The modem card is further provided with an antenna structure which is in electrical communication with the communications circuitry. The antenna structure is translatable from a first position wherein the antenna structure is substantially disposed within the cavity and a second position wherein the antenna structure is extended from the cavity.

Thus, the antenna structure is adapted to slidably engage the cavity of the modem card. Such engagement facilitates extension of the antenna structure, while in the second position, from the host computer only when necessary. It is contemplated that the modem card could be used in a host computer such that the entire modem card is disposed within the structure of the host computer. It is contemplated that when the antenna structure is in operation, it is slid out of the first end of the circuit board and extended, external to the host computer. When the antenna structure is not in use, it can be retracted into the cavity, into the first position, thereby leaving substantially little or no portion of the modem card external to the host computer.

Importantly, the dimensions of the modem card when the antenna structure is retracted into the first position is contemplated to be no greater than the three PCMCIA standard types, namely, Type I, Type II, and Type III, each having a length of 85.6 mm, a width of 54.0 mm, and respective thicknesses of 3.3, 5.0 and 10.5 millimeters.

In addition, the antenna structure is provided with a slide portion and an antenna. The slide portion is in electrical communication with the communications circuitry. The slide portion and the antenna are translatable through the cavity when the antenna structure is moved between the first and second positions. The antenna structure is further provided with a ball joint rotably connected to the slide portion and the antenna. It is contemplated that the ball joint enables the antenna to rotate and pivot and is therefore free to move for proper polarization of the antenna and to mitigate against multipath reflections.

Preferably, the modem card is provided with an extension spring which is disposable in the cavity and is in mechanical communication with the slide portion and the circuit board. The extension spring is formed to urge the antenna out of the cavity when the antenna structure is in the first position. Similarly, modem card is also provided with a retraction spring which is disposable in the cavity and is in mechanical communication with the slide portion and the circuit board. The retraction spring is formed to urge the antenna into the cavity when the antenna structure is in the second position. It is contemplated that the extension spring and the retraction spring are a single extension/retraction spring.

In another embodiment of the present invention, the antenna structure is provided with a slide portion and an antenna and the modem card is further provided with a micro-motor. The micro-motor is in mechanical communication with the slide portion and the circuit board for urging the antenna between the first and second positions. The modem card is provided with a control device which is in electronic communication with the micro-motor, for controlling the micro-motor in response to sensed operation of the modem card. Thus, the micro-motor facilitates automatic extension and retraction of the antenna structure.

In addition, the modem card is provided with a PCMCIA interface which is attachable to a second end of the circuit board. The PCMCIA interface is in electrical communication with the communications circuitry.

Preferably, the modem card is provided with a retraction lock device which is disposed between the slide portion and the circuit board. The retraction lock device is formed to releasably lock the antenna structure into position when the antenna structure is in the first position. The retraction lock device is provided with a first retraction connector attached to the slide portion and a second retraction connector attached to and disposed within the cavity and formed to releasably engage the first retraction connector. Similarly, there is provided an extension lock device formed to releasably lock the antenna structure into position when the antenna structure is in the second position. The extension lock device is provided with a first extension connector attached to the slide portion and a second extension connector attached to and disposed within the cavity and formed to releasably engage the first extension connector.

In the preferred embodiment of the present invention, the antenna is a patch antenna. The antenna is provided with an antenna side and a circuit side. The antenna is provided with a low-noise amplifier attached to the circuit side. The low-noise amplifier is in electrical communication with the antenna side and the communications circuitry. Furthermore, the antenna may be formed of a copper material.

In another embodiment of the present invention, the modem card is provided with a circuit board, having a first cavity and a second cavity extending to a first end of the circuit board. The modem card is further provided with communications circuitry formed on the circuit board. The modem card is further provided with a first antenna structure which is in electrical communication with the communications circuitry. The first antenna structure is translatable from a first position wherein the first antenna structure is substantially disposed within the first cavity and a second position wherein the first antenna is extended from the first cavity. The modem card is further provided with a second antenna structure which is in electrical communication with the communications circuitry. The second antenna structure is translatable from a second position wherein the second antenna structure is substantially disposed within the second cavity and a second position wherein the second antenna is extended from the second cavity. It is contemplated that the integration of the first and second antenna structures into the modem card allow for space diversity and selective use of either of the two antennas structures.

Preferably, the first and second antenna structures are generally parallel to each other, and the modem card is provided with a connecting bar having a first end attached to the first antenna structure and a second end attached to the second antenna structure, for manually extending the first and second antenna structures between the first and second positions. In the preferred embodiment of the present invention, the first and second antenna structures are patch antennas.

The present invention mitigates problems associated with prior art designs. The extendable antenna may be a patch antenna. Patch antennas are desirable due to their inherently thin nature. Because the antenna may be relatively thin, the antenna facilitates integration into the cavity formed in the circuit board. The overall thickness of the modem card may be reduced as compared to prior art designs which call for an antenna to be affixed to one of the sides of the circuit board of the modem card.

Importantly, the dimensions of the modem card of the present invention when the antenna structure is retracted into the cavity of the circuit board, in the first position, is contemplated to be no greater than the three PCMCIA standard types, namely, Type I, Type II, and Type III, each having a length of 85.6 mm, a width of 54.0 mm, and respective thicknesses of 3.3, 5.0 and 10.5 millimeters.

Another feature of the present invention is that the antenna structure is designed to slidably engage the cavity of the modem card. Such engagement facilitates extension of the antenna from the host computer only when necessary. It is contemplated that the modem card would be used in a host computer such that the entire card is substantially disposed within the structure of the host computer. Thus, when the antenna is in operation, it is slid out of the opening of the cavity of the circuit board and extended, external to the host computer. When the antenna is not in use, it can be retracted into the cavity, thereby leaving little or no portion of the modem card external to the host computer. Advantageously, the antenna structure may be provided with a micro-motor. Such a micro-motor facilitates automatic extension and retraction of the antenna. Another embodiment of the present invention utilizes mechanical springs to semiautomatically extend and retract the antenna.

Yet another feature of the present invention is that the antenna structure facilitates adjustment and reorientation of the antenna through the use of the ball-joint disposed between the slide portion and the antenna. The ball-joint enables the antenna to rotate and pivot and is therefore free to move to allow for proper polarization of the antenna and to mitigate against multipath reflections.

Where a patch antenna is utilized in the present invention, a low-noise amplifier may be provided and attached to one side of the antenna itself. By designing the amplifier to travel along with the patch antenna, losses associated with channeling received low signal strength signals to an amplifier located at some longer distance away from the antenna may be mitigated.

Finally, another feature of the present invention is that the modem card may be provided with two antennas for space diversity. Because the two antennas are located at a given distance apart from one another, under certain circumstances one of the two antennas may receive a given signal at a higher signal strength. This is especially the case where high frequency signals are received and the modem card is used in a highly reflective environment, such as in an office setting. Such a design allows for selective utilization either of the two antennas depending upon their relative signal strengths.

Accordingly, the present invention represents a significant advance in the art.

BRIEF DESCRIPTION OF THE DRAWINGS

These, as well as other features of the present invention, will become more apparent upon reference to the drawings wherein.

DETAILED DESCRIPTION OF THE PREFERRED EMBODIMENT

Figure 1:
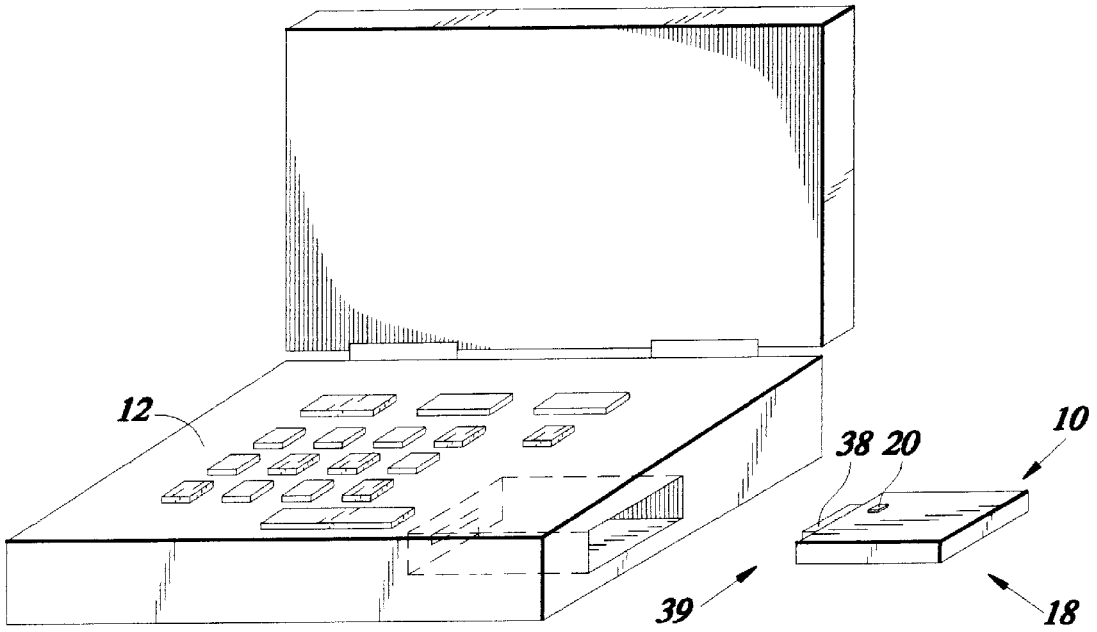
FIG. 1 is a perspective view of the PCMCIA modem card of the present invention in relation to a host laptop computer, prior to insertion to the host laptop computer.

Referring now to the drawings wherein the showings are for purposes of illustrating a preferred embodiment of the present invention only, and not for purposes of limiting the same, FIGS. 1–14 illustrate a PCMCIA modem card 10 which is constructed in accordance with the present invention. As will be described in more detail below, the PCMCIA modem card 10 utilizes an integrated, extendable antenna.

Referring now to FIGS. 1–8, in accordance with the present invention, a PCMCIA modem card 10 which is connectable a host computer 12 and utilizes an integrated, extendable antenna for wireless transmission and reception, is provided with a circuit board 14. The circuit board 14 is provided with a cavity 16 interior extending to a first end 18 of the circuit board 14. The modem card 10 is further provided with communications circuitry 20 which is formed on the circuit board 14.

The modem card 10 is further provided with an antenna structure 22 which is in electrical communication with the communications circuitry 20. The antenna structure 22 is translatable from a first position wherein the antenna structure 22 is substantially disposed within the cavity 16 and a second position wherein the antenna structure 22 is extended from the cavity 16.

Figure 2:
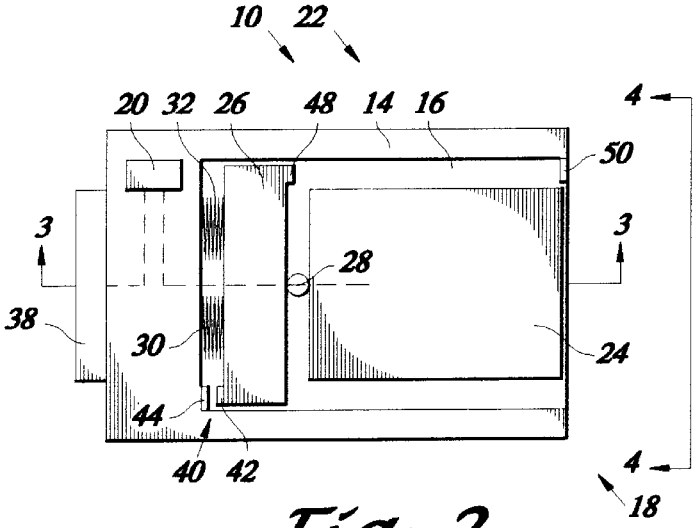
FIG. 2 is a cross-sectional top view of the present invention, illustrated with the antenna in a retracted position.
Figure 3:
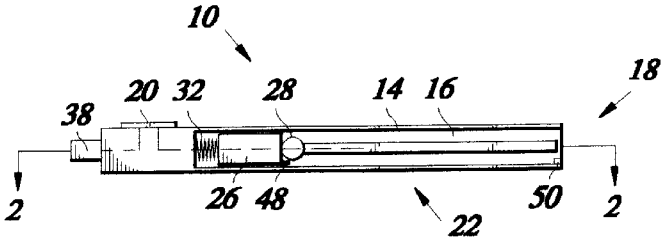
FIG. 3 is a side view of the present invention of FIG. 2, as seen along axis 3—3.
Figure 4:
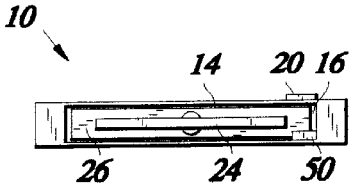
FIG. 4 is a side view of the present invention of FIG. 2, as seen along axis 4—4.
Figure 5:
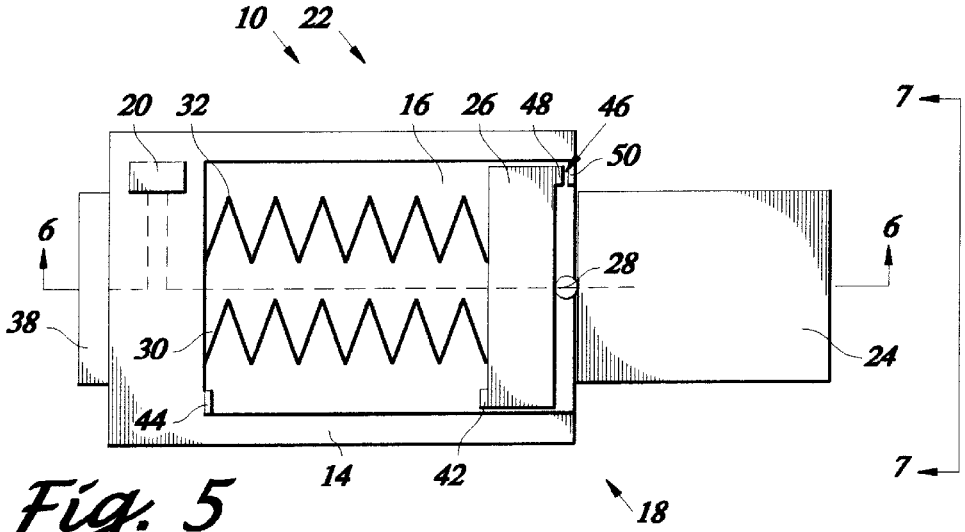
FIG. 5 is a cross-sectional top view of the present invention, shown with the antenna in an extended position.
Figure 6:
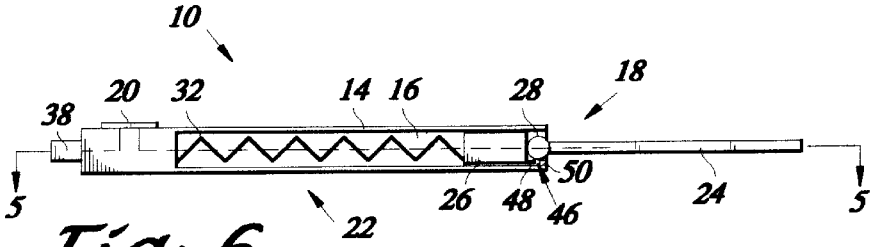
FIG. 6 is a side view of the present invention of FIG. 5, as seen along axis 6—6.
Figure 7:
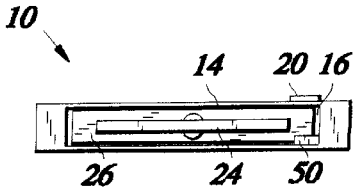
FIG. 7 is a side view of the present invention of FIG. 5, as seen along axis 7—7.

Referring now to FIGS. 2–4, illustrated is the modem card 10 of the present invention shown with the antenna structure 22 retracted in the first position. Whereas, referring now to FIG. 5–7, illustrated is the modem card 10 shown with the antenna structure 22 extended to the second position.

Figure 8:
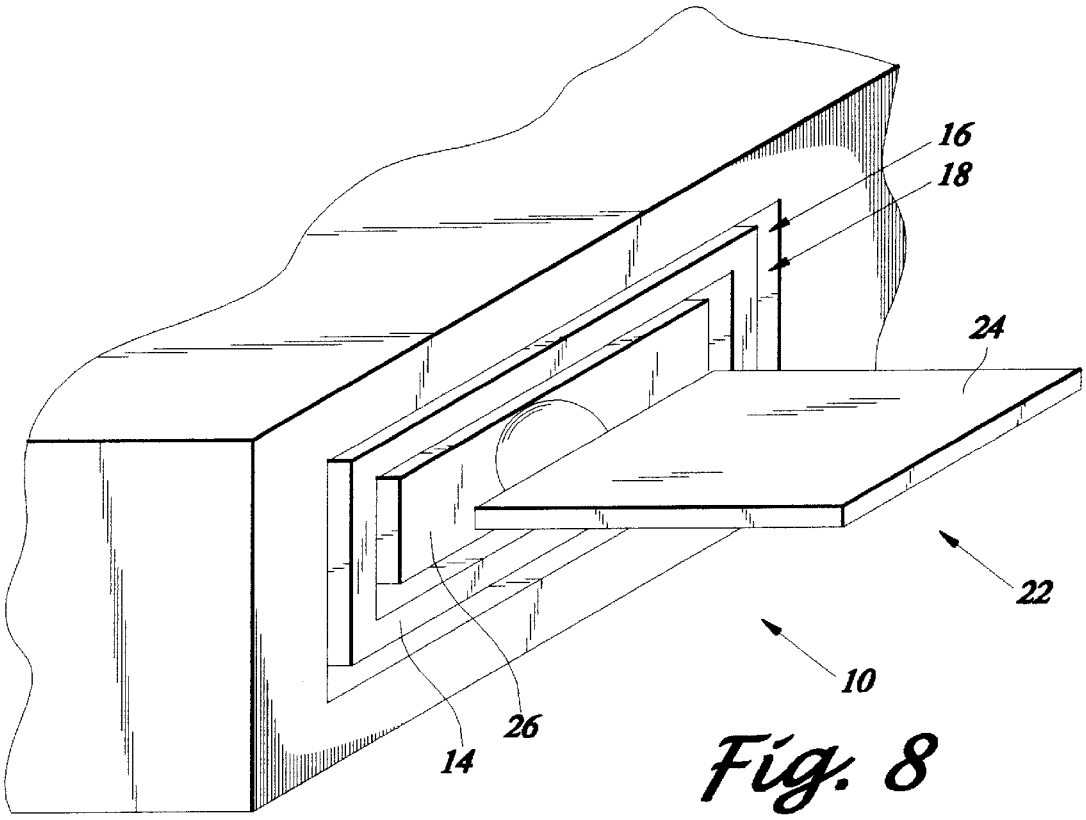
FIG. 8 is a perspective view of the present invention in relation to a host top computer, as inserted into a host laptop computer and with the antenna extended.

Thus, the antenna structure 22 is designed to slidably engage the cavity 16 of the modem card 10. Such engagement facilitates extension of the antenna structure 22 from the host computer 12 only when necessary. It is contemplated that the modem card 10 could be used in a host computer 12 such that the entire modem card 10 is disposed within the structure of the host computer 12. It is contemplated that when the antenna structure 22 is in operation, it is slid out of the opening 18 of the cavity 16 of the circuit board 14 and extended to the second position, external to the host computer 12, as illustrated in FIG. 8. When the antenna structure 22 is not in use, it can be retracted into the cavity 16 into the first position, thereby leaving substantially little or no portion of the modem card 10 external to the host computer 12. Importantly, the dimensions of the modem card 10 of the present invention when the antenna structure 22 is in the first position is contemplated to be no greater than the three PCMCIA standard types, namely, Type I, Type II, and Type III, each having a length of 85.6 mm, a width of 54.0 mm, and respective thicknesses of 3.3, 5.0 and 10.5 millimeters.

In addition, the antenna structure 22 is provided with an antenna 24 and a slide portion 26. The slide portion 26 is formed to be in slidable engagement with the cavity 16 and is in electrical communication with the communications circuitry 20. The slide portion 26 and the antenna 24 are translatable through the cavity 16 when the antenna structure 22 is moved between the first and second positions. The antenna structure 22 is further provided with a ball joint 28 rotably connected to the slide portion 26 and the antenna 24. It is contemplated that the ball joint enables the antenna 24 to rotate and pivot and is therefore free to move for proper polarization of the antenna 24 and to mitigate against multipath reflections. Although a ball joint 28 is employed in the present invention, it is contemplated that other mechanical attachment arrangements could be employed which would similarly facilitate antenna 24 freedom of movement which are known to those of ordinary skill in the art.

Preferably, the modem card 10 is provided with an extension spring 30 which is disposable in the cavity 16 and is in mechanical communication with the slide portion 26 and the circuit board 14. The extension spring 30 is formed to urge the antenna 24 out of the cavity 16 when the antenna structure 22 is in the first position. Similarly, modem card 10 is also provided with a retraction spring 32 which is disposable in the cavity 16 and is in mechanical communication with the slide portion 26 and the circuit board 14. The retraction spring 32 is formed to urge the antenna 24 into the cavity 16 when the antenna structure 22 is in the second position. It is contemplated that the extension spring 30 and the retraction spring 32 are the same extension/retraction spring. In such a case, it is contemplated that the natural length of such a spring is less than the extended length of the spring when the antenna structure 22 is in the second position and is therefore in tension. Further, such a spring would be in a compressive state when the antenna structure 22 is retracted into the cavity 16, in the first position.

Figure 9:
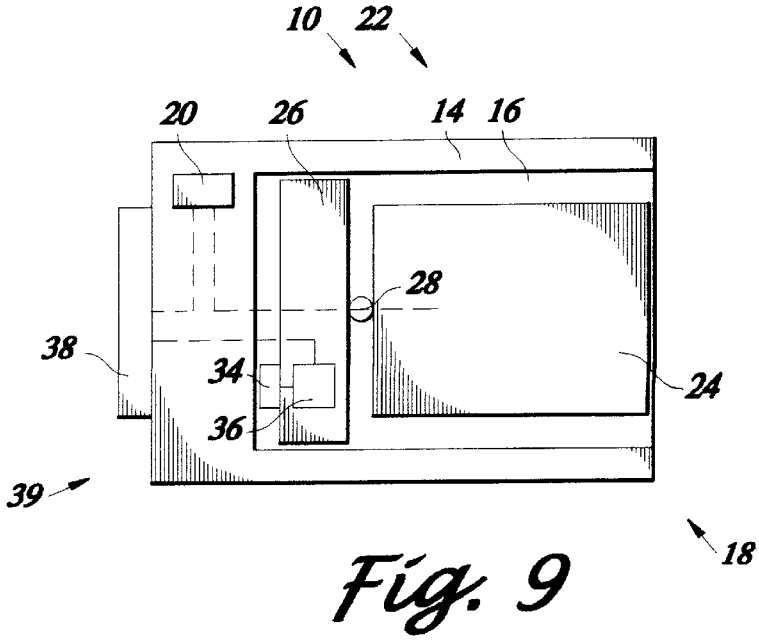
FIG. 9 is a top view of another embodiment of the present invention utilizing a micro-motor.

Referring now to FIG. 9, in another embodiment of the present invention, the antenna structure 22 is provided with a slide portion 26 and an antenna 24 and the modem card 10 is further provided with a micro-motor 34. The micro-motor 34 is in mechanical communication with the slide portion 26 and the circuit board 14 for urging the antenna structure 22 between the first and second positions. The method of mechanical communication between the micro-motor 34 and the slide portion 26 is contemplated to be chosen from those well known to those of ordinary skill in the art. The modem card 10 is provided with a control device 36 which is in electronic communication with the micro-motor 34, for controlling the micro-motor 34 in response to sensed operation of the modem card 10. Thus, the micro-motor 34 facilitates automatic extension and retraction of the antenna structure 22 between the first and second positions.

In addition, the modem card 10 is provided with a PCMCIA interface 38 which is attachable to a second end of 39 the circuit board 14. It is contemplated that the PCMCIA interface 38 is a standard 68-pin connector. The PCMCIA interface 38 is in electrical communication with the communications circuitry.

Preferably, the modem card 10 is provided with a retraction lock device 40 which is disposed between the slide portion 26 and the circuit board 14. The retraction lock device 40 may be chosen from those well known to those of ordinary skill in the art. The retraction lock device 40 is formed to releasably lock the antenna structure 22 into position when the antenna structure 22 is in the first position. The retraction lock device 40 is provided with a first retraction connector 42 attached to the slide portion 26 and a second retraction connector 44 attached to and disposed within the cavity 16 and formed to releasably engage the first retraction connector 42.

Similarly, there is provided an extension lock device 46 formed to releasably lock the antenna structure 22 into position when the antenna structure 22 is in the second position. The extension lock device 46 may be chosen from those well known to those of ordinary skill in the art. The extension lock device 46 is provided with a first extension connector 48 attached to the slide portion 26 and a second extension connector 50 attached to and disposed within the cavity 16 and formed to releasably engage the first extension connector 48.

In the preferred embodiment of the present invention, the antenna 24 is a patch antenna. It is contemplated that the antenna 24 may be square in nature. The dimensions of the antenna 24 may be up to 54.0 mm on each side (the maximum width of a standard PCMCIA Card). In practice, the dimensions of the antenna 24 are contemplated to be a function of the frequency of the signal desired to be received. Some typical frequencies are contemplated to be 2.5, 2.5, and 5.6 GHz, for example. It is contemplated that the thickness of the antenna 24, although not essential, may be less than a millimeter, for example. It is further contemplated that the antenna 24 may be of other types and physical configurations, such as, tubular, whip-type, telescoping, fractal, helical, and others chosen from those well known to one of ordinary skill in the art.

Figure 10:
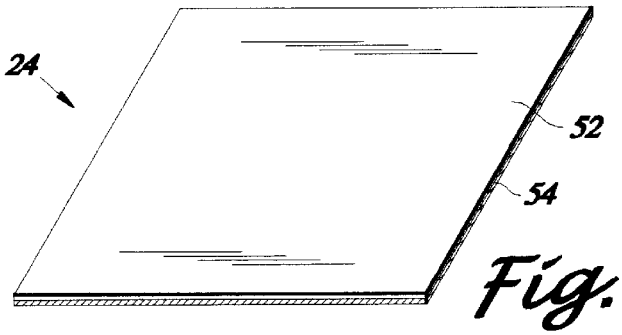
FIG. 10 is a symbolic/perspective view of an antenna of the present invention, illustrated with the antenna side of the antenna facing upwards.
Figure 11:
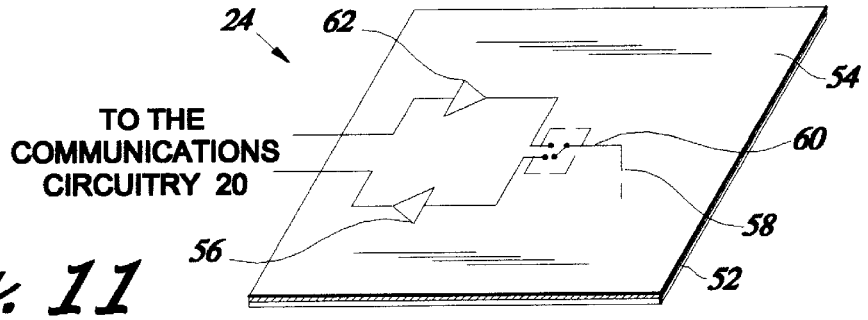
FIG. 11 is a symbolic/perspective view of an antenna of the present invention, illustrated with the circuit side of the antenna facing upwards.
Figure 12:
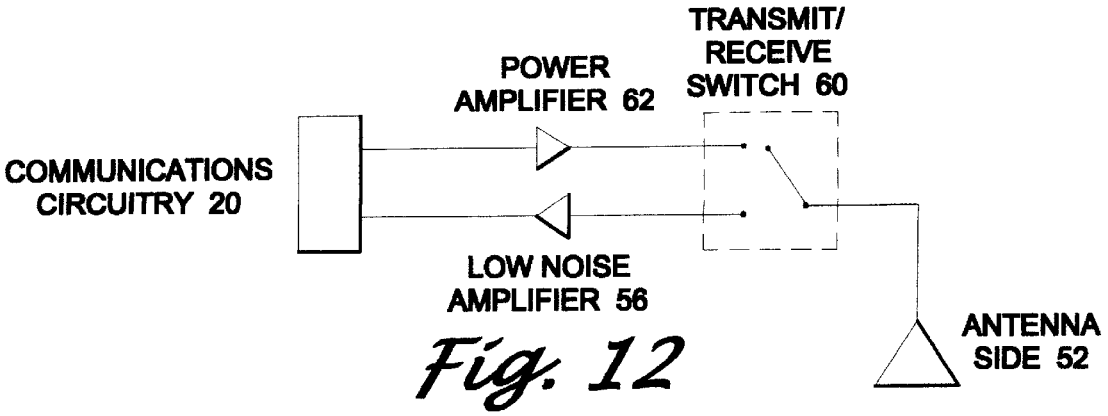
FIG. 12 is a schematic illustration of the antenna circuitry.
Figure 13:
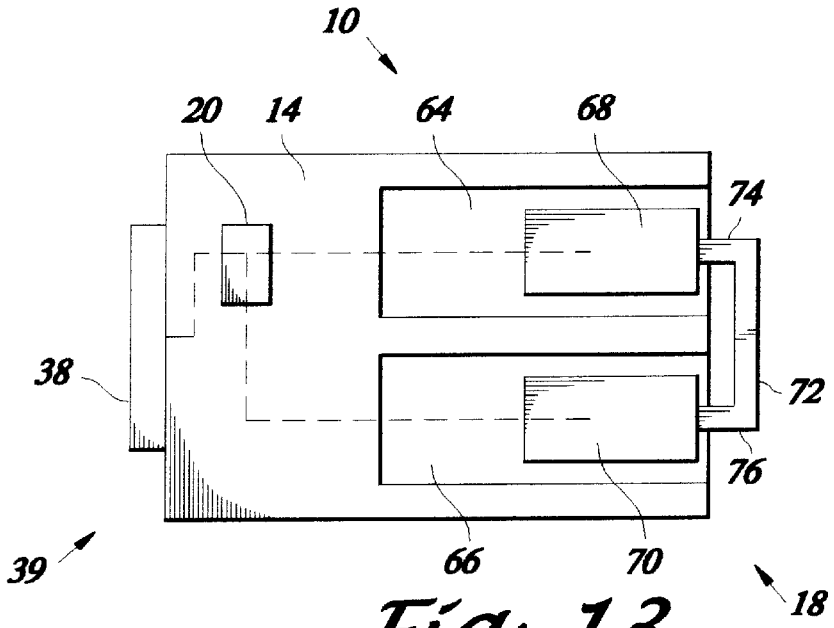
FIG. 13 is a cross-sectional top view of another embodiment of the present invention, illustrated with the first antenna and second antenna in a retracted position.
Figure 14:
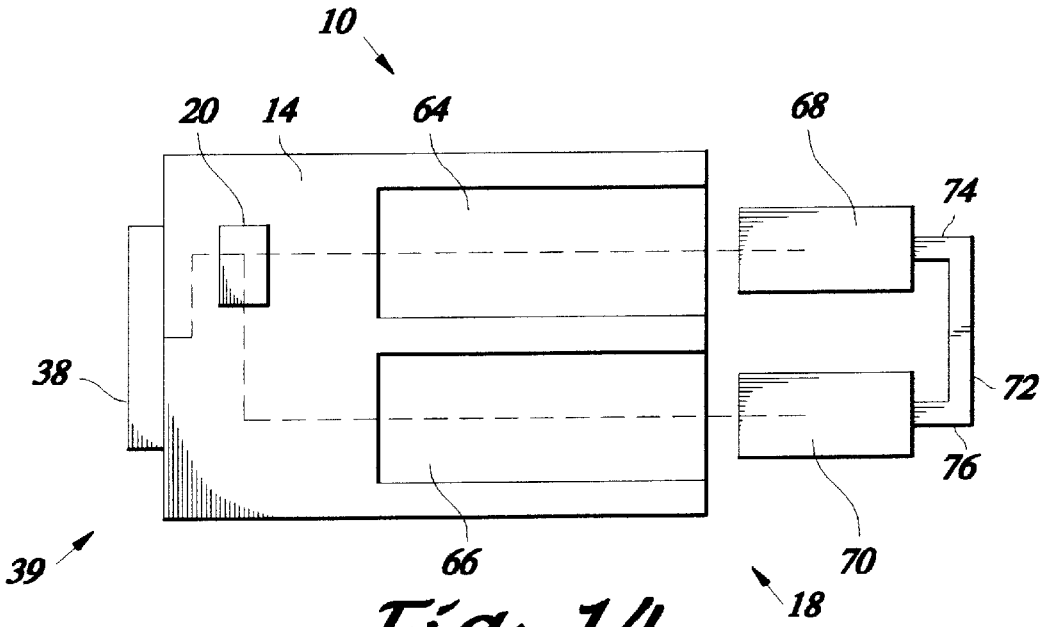
FIG. 14 is a cross-sectional top view of the present invention depicted in FIG. 13, illustrated with the first antenna and second antenna in an extended position.

In the present embodiment, the antenna 24 is formed of a copper material. It is contemplated, however, that the antenna 24 may be formed of any number of other materials chosen from those well known to those of ordinary skill in the art. Referring now to FIGS. 10 and 11, the antenna 24 may be provided with an antenna side 52 and a circuit side 54. Thus, it is contemplated that the antenna 24 may comprise a sheet of copper foil (the antenna side 52) affixed to a layer of a substrate (the circuit side 54). It is contemplated that the layer of substrate may comprise any number of materials having relatively low conductivity. For example, the substrate may comprise a phenolic, ceramic, or plastic material. Referring now to FIGS. 11 and 12 (schematic diagram), the antenna 24 is provided with a low-noise amplifier 56 attached to the circuit side 54. The low-noise amplifier 56 is in electrical communication with the antenna side 52 and the communications circuitry 20. Although not shown, it is contemplated that the low-noise amplifier 56 would be provided with a power source (a dedicated wire or cable) originating from the circuit board 14. It is contemplated that the low-noise amplifier 56 may be electrically connected to the antenna side 52 through the substrate using a via 58 (symbolically shown as a dashed line). It is contemplated that by designing the low-noise amplifier 56 to travel along with the antenna 24, losses associated with channeling received low signal strength signals to the low-noise amplifier 56 are mitigated in comparison to locating the amplifier at some longer distance away from the antenna 24. It is further contemplated that a transmit/receive switch (T/R switch) 60 and a power amplifier 62 for transmission may also be affixed to the circuit side 54 of the antenna 24.

In another embodiment of the present invention, the modem card 10 is provided with a circuit board 14, having a first cavity 64 and a second cavity 66 extending to a first end 18 of the circuit board 14. The modem card 10 is further provided with communications circuitry 20 formed on the circuit board 14. The modem card 10 is further provided with a first antenna structure 68 which is in electrical communication with the communications circuitry 20. The first antenna structure 68 is translatable from a first position wherein the first antenna structure 68 is substantially disposed within the first cavity 64 and a second position wherein the first antenna structure 68 is extended from the first cavity 64. The modem card is further provided with a second antenna structure 70 which is in electrical communication with the communications circuitry 20. The second antenna structure 70 is translatable from a second position wherein the first antenna structure 70 is substantially disposed within the second cavity 66 and a second position wherein the second antenna structure 70 is extended from the second cavity 66. It is contemplated that the integration of the first and second antenna structures 68, 70 into the modem card 10 allow for space diversity and selective use of either of the two antennas 68, 70. Because the first and second antenna structures 68, 70 are located at a given distance apart from one another, it is contemplated that under certain circumstances one of the two antenna structures 68, 70 may receive a given signal at a higher signal strength. This is especially the case where high frequency signals are received and the modem card 10 is used in a highly reflective environment, such as in an office setting. It is contemplated that such a design allows for selective utilization either of the two antenna structures 68, 70 depending upon their relative signal strengths.

Preferably, the first and second antenna structures 68, 70 are generally parallel to each other, and the modem card 10 is provided with a connecting bar 72 having a first end 74 attached to the first antenna structure 68 and a second end 76 attached to the second antenna structure 70, for manually extending the first and second antenna structures 68, 70 between the first and second positions. In the preferred embodiment of the present invention, the first and second antenna structures 68, 70 are patch antennas.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. A PCMCIA modem card which is connectable to a host computer and utilizes an integrated, extendable antenna for wireless transmission and reception, the PCMCIA modem card comprising:

a circuit board having a cavity interior, the cavity extending to a first end of the circuit board;

communications circuitry formed on the circuit board; and an antenna structure, in electrical communication with the communications circuitry, the antenna structure being translatable from a first position wherein the antenna structure is substantially disposed within the cavity and a second position wherein the antenna structure is extended from the cavity, the antenna structure having a slide portion and an antenna, the slide portion being in electrical communication with the communications circuitry, the slide portion and the antenna being translatable through the cavity when the antenna structure is moved between the first and second positions; and a ball joint rotably connected to the slide portion and the antenna.

2. The PCMCIA modem card of claim 1 wherein the modem card further comprises an extension spring, disposable in the cavity, in mechanical communication with the slide portion and the circuit board, the extension spring being formed to urge the antenna out of the cavity when the antenna structure is in the first position.

3. The PCMCIA modem card of claim 2 wherein the modem card further comprises a retraction spring, disposable in the cavity, in mechanical communication with the slide portion and the circuit board, the retraction spring being formed to urge the antenna into the cavity when the antenna structure is in the second position.

4. The PCMCIA modem card of claim 3 wherein the extension spring and the retraction spring are a single extension/retraction spring.

5. The PCMCIA modem card of claim 1 wherein the modem card further comprises a micro-motor, disposed between and in mechanical communication with the slide portion and the circuit board for urging the antenna structure between the first and second positions.

6. The PCMCIA modem card of claim 5 further comprises a control device, in electronic communication with the micro-motor, for controlling the micro-motor in response to sensed operation of the modem card.

7. The PCMCIA modem card of claim 1 further comprises a PCMCIA interface, attachable to the circuit board, in electrical communication with the communications circuitry.

8. The PCMCIA modem card of claim 7 wherein the PCMCIA interface is disposed at a second end of the circuit board.

9. The PCMCIA modem card of claim 1 further comprises a retraction lock device, disposed between the slide portion and the circuit board, formed to releasably lock the antenna structure into position when the antenna structure is in the first position.

10. The PCMCIA modem card of claim 9 wherein the retraction lock device comprises a first retraction connector attached to the slide portion and a second retraction connector attached to and disposed within the cavity and formed to releasably engage the first retraction connector.

11. The PCMCIA modem card of claim 1 further comprises an extension lock device, disposed between the slide portion and the circuit board, formed to releasably lock the antenna structure into position when the antenna structure is in the second position.

12. The PCMCIA modem card of claim 11 wherein the extension lock device comprises a first extension connector attached to the slide portion and a second extension connector attached to and disposed within the cavity and formed to releasably engage the first extension connector.

13. The PCMCIA modem card of claim 1 wherein the antenna is a patch antenna.

14. The PCMCIA modem card of claim 13 wherein the antenna having an antenna side and a circuit side, the antenna further comprises a low-noise amplifier attached to the circuit side, in electrical communication with the antenna side and the communications circuitry.

15. The PCMCIA modem card of claim 14 wherein the antenna is formed of a copper material.

16. A PCMCIA modem card which is connectable a host computer and utilizes integrated, extendable space diverse antennas for wireless transmission and reception, the PCMCIA modem card comprising:

a circuit board having a first cavity and second cavity interior, the first cavity and second cavity extending to a first end of the circuit board;

communications circuitry formed on the circuit board;

a first antenna structure, in electrical communication with the communications circuitry, the first antenna structure being translatable from a first position wherein the first antenna structure is substantially disposed within the first cavity and a second position wherein the first antenna structure is extended from the first cavity; and a second antenna structure, in electrical communication with the communications circuitry, the second antenna structure being translatable from a first position wherein the second antenna structure is substantially disposed within the second cavity and a second position wherein the second antenna structure is extended from the second cavity.

17. The PCMCIA modem card of claim 16 wherein the first antenna structure and the second antenna structure being generally parallel to each other, and the modem card further comprises a connecting bar having a first end attached to the first antenna structure and a second end attached to the second antenna structure, for manually translating the first and second antenna structures between the first and second positions.

18. The PCMCIA modem card of claim 16 wherein the first and second antenna structures are patch antennas.

19. A PCMCIA modem card which is connectable to a host computer and utilizes an integrated, extendable antenna for wireless transmission and reception, the PCMCIA modem card comprising:

a circuit board having a cavity interior, the cavity extending to a first end of the circuit board;

communications circuitry formed on the circuit board;

an antenna structure, in electrical communication with the communications circuitry, the antenna structure being translatable from a first position wherein the antenna structure is substantially disposed within the cavity and a second position wherein the antenna structure is extended from the cavity, the antenna structure having a slide portion and an antenna, the slide portion being in electrical communication with the communications circuitry, the slide portion and the antenna being translatable through the cavity when the antenna structure is moved between the first and second positions; and an extension spring, disposable in the cavity, in mechanical communication with the slide portion and the circuit board, the extension spring being formed to urge the antenna out of the cavity when the antenna structure is in the first position.

20. The PCMCIA modem card of claim 19 wherein the antenna structure further comprises a ball joint rotably connected to the slide portion and the antenna.

21. The PCMCIA modem card of claim 19 wherein the modem card further comprises a retraction spring, disposable in the cavity, in mechanical communication with the slide portion and the circuit board, the retraction spring being formed to urge the antenna into the cavity when the antenna structure is in the second position.

22. The PCMCIA modem card of claim 21 wherein the extension spring and the retraction spring are a single extension/retraction spring.

23. The PCMCIA modem card of claim 19 wherein the modem card further comprises a micro-motor, disposed between and in mechanical communication with the slide portion and the circuit board for urging the antenna structure between the first and second positions.

24. The PCMCIA modem card of claim 23 further comprises a control device, in electronic communication with the micro-motor, for controlling the micro-motor in response to sensed operation of the modem card.

25. The PCMCIA modem card of claim 19 further comprises a PCMCIA interface, attachable to the circuit board, in electrical communication with the communications circuitry.

26. The PCMCIA modem card of claim 25 wherein the PCMCIA interface is disposed at a second end of the circuit board.

27. The PCMCIA modem card of claim 19 further comprises a retraction lock device, disposed between the slide portion and the circuit board, formed to releasably lock the antenna structure into position when the antenna structure is in the first position.

28. The PCMCIA modem card of claim 27 wherein the retraction lock device comprises a first retraction connector attached to the slide portion and a second retraction connector attached to and disposed within the cavity and formed to releasably engage the first retraction connector.

29. The PCMCIA modem card of claim 19 further comprises an extension lock device, disposed between the slide portion and the circuit board, formed to releasably lock the antenna structure into position when the antenna structure is in the second position.

30. The PCMCIA modem card of claim 29 wherein the extension lock device comprises a first extension connector attached to the slide portion and a second extension connector attached to and disposed within the cavity and formed to releasably engage the first extension connector.

31. The PCMCIA modem card of claim 19 wherein the antenna is a patch antenna.

32. The PCMCIA modem card of claim 31 wherein the antenna having an antenna side and a circuit side, the antenna further comprises a low-noise amplifier attached to the circuit side, in electrical communication with the antenna side and the communications circuitry.

33. The PCMCIA modem card of claim 32 wherein the antenna is formed of a copper material.

34. A PCMCIA modem card which is connectable to a host computer and utilizes an integrated, extendable antenna for wireless transmission and reception, the PCMCIA modem card comprising:

a circuit board having a cavity interior, the cavity extending to a first end of the circuit board;

communications circuitry formed on the circuit board; and an antenna structure, in electrical communication with the communications circuitry, the antenna structure being translatable from a first position wherein the antenna structure is substantially disposed within the cavity and a second position wherein the antenna structure is extended from the cavity, the antenna structure having a slide portion and an antenna, the slide portion being in electrical communication with the communications circuitry, the slide portion and the antenna being translatable through the cavity when the antenna structure is moved between the first and second positions; and a micro-motor, disposed between and in mechanical communication with the slide portion and the circuit board for urging the antenna structure between the first and second positions.

35. The PCMCIA modem card of claim 34 wherein the antenna structure further comprises a ball joint rotably connected to the slide portion and the antenna.

36. The PCMCIA modem card of claim 34 wherein the modem card further comprises an extension spring, disposable in the cavity, in mechanical communication with the slide portion and the circuit board, the extension spring being formed to urge the antenna out of the cavity when the antenna structure is in the first position.

37. The PCMCIA modem card of claim 36 wherein the modem card further comprises a retraction spring, disposable in the cavity, in mechanical communication with the slide portion and the circuit board, the retraction spring being formed to urge the antenna into the cavity when the antenna structure is in the second position.

38. The PCMCIA modem card of claim 37 wherein the extension spring and the retraction spring are a single extension/retraction spring.

39. The PCMCIA modem card of claim 34 further comprises a PCMCIA interface, attachable to the circuit board, in electrical communication with the communications circuitry.

40. The PCMCIA modem card of claim 39 wherein the PCMCIA interface is disposed at a second end of the circuit board.

41. The PCMCIA modem card of claim 38 further comprises a retraction lock device, disposed between the slide portion and the circuit board, formed to releasably lock the antenna structure into position when the antenna structure is in the first position.

42. The PCMCIA modem card of claim 41 wherein the retraction lock device comprises a first retraction connector attached to the slide portion and a second retraction connector attached to and disposed within the cavity and formed to releasably engage the first retraction connector.

43. The PCMCIA modem card of claim 34 further comprises an extension lock device, disposed between the slide portion and the circuit board, formed to releasably lock the antenna structure into position when the antenna structure is in the second position.

44. The PCMCIA modem card of claim 43 wherein the extension lock device comprises a first extension connector attached to the slide portion and a second extension connector attached to and disposed within the cavity and formed to releasably engage the first extension connector.

45. The PCMCIA modem card of claim 34 wherein the antenna is a patch antenna.

46. The PCMCIA modem card of claim 45 wherein the antenna having an antenna side and a circuit side, the antenna further comprises a low-noise amplifier attached to the circuit side, in electrical communication with the antenna side and the communications circuitry.

47. The PCMCIA modem card of claim 46 wherein the antenna is formed of a copper material.

* * * * *